United States Patent [19]

Okumura et al.

[11] 4,426,902

[45] Jan. 24, 1984

[54] TOUCH-RESPONSIVE CONTROL APPARATUS FOR ELECTRONIC MUSICAL INSTRUMENTS

[75] Inventors: Takatoshi Okumura; Shigemitsu Yamaoka, both of Hamamatsu, Japan

[73] Assignee: Nippon Gakki Seizo Kabushiki Kaisha, Hamamatsu, Japan

[21] Appl. No.: 347,185

[22] Filed: Feb. 9, 1982

Related U.S. Application Data

[63] Continuation of Ser. No. 210,345, Nov. 25, 1980, abandoned.

[30] Foreign Application Priority Data

Nov. 30, 1979 [JP] Japan ..... 54-155786

[51] Int. Cl.[3] ..... G10H 1/057; G10H 1/46

[52] U.S. Cl. ..... 84/1.1; 84/1.13; 84/1.26; 84/1.27

[58] Field of Search ..... 84/1.1, 1.13, 1.26, 84/1.27

[56] References Cited

U.S. PATENT DOCUMENTS

| | | | |
|---|---|---|---|
| 2,215,709 | 9/1940 | Miessner | 84/1.26 |
| 2,481,608 | 9/1949 | McKellip | 84/1.26 X |
| 2,482,548 | 9/1949 | Kerkhof | 84/1.26 |
| 2,918,576 | 12/1959 | Munch, Jr. | 84/1.26 X |
| 3,003,383 | 10/1961 | Williams | 84/1.26 |
| 3,267,200 | 8/1966 | Anderson et al. | 84/1.26 |
| 3,465,088 | 9/1969 | Kohls | 84/1.26 |
| 3,784,718 | 1/1974 | Uchiyama | 84/1.13 |
| 3,816,636 | 6/1974 | Peltz | 84/1.1 |
| 4,067,253 | 1/1978 | Wheelwright et al. | 84/1.1 |
| 4,121,348 | 10/1978 | Niinomi et al. | 84/1.13 X |
| 4,211,141 | 7/1980 | Jensen et al. | 84/1.27 |

FOREIGN PATENT DOCUMENTS 48-42932 12/1973 Japan .

*Primary Examiner*—Stanley J. Witkowski

*Attorney, Agent, or Firm*—Spensley, Horn, Jubas & Lubitz

[57] ABSTRACT

A key-speed-responsive volume control apparatus for a keyboard-type electronic musical instrument includes a key switch associated with a key of the instrument, wherein a movable contact of the key switch moves out of engagement with a break contact and into engagement with a make contact upon depression of the key. A capacitor is charged following the movement of the movable contact out of engagement with the break contact and before engagement with the make contact. The capacitor is made to discharge at a first prescribed rate immediately after charging until the movable contact comes into engagement with the make contact, and then at a second prescribed rate until the movable contact disengages the make contact upon release of the key. The terminal voltage of the capacitor when the movable contact comes into engagement with the make contact is utilized for controlling the amplitude of a tone source signal corresponding to the depressed key, thereby providing a tone signal having an initial amplitude determined in accordance with the speed of key depression. Necessitating the use of only one capacitor for each key, the apparatus is suitable for fabrication in the form of an integrated circuit.

20 Claims, 9 Drawing Figures

TOUCH-RESPONSIVE CONTROL APPARATUS FOR ELECTRONIC MUSICAL INSTRUMENTS

This is a continuation of application Ser. No. 210,345, filed Nov. 25, 1980, and now abandoned.

BACKGROUND OF THE INVENTION

This invention pertains to key-operated electronic musical instruments, and more specifically to a system or circuitry responsive to the depression speeds of individual keys on such an instrument for controlling the tone production manner of corresponding tones in conformity with the speeds at which the keys have been depressed.

As heretofore incorporated in a keyboard-type electronic musical instrument, a typically touch-responsive volume control system is shown in FIG. 1 in which a first capacitor 2 is charged by a voltage supply $+V_1$ through a key switch 1 while the key corresponding thereto is not depressed. The charge on the capacitor 2 is released to ground through a resistor 3 when the movable contact of the key switch 1 moves out of engagement with its break contact upon depression of the key. When the movable contact of the key switch subsequently comes into engagement with its make contact, the remaining voltage of the capacitor 2 is used to cause conduction through a transistor 4. Thereupon a voltage supply $+V_2$ charges a second capacitor 5 to an extent corresponding to the remaining voltage of the first capacitor 2. As the second capacitor 5 subsequently discharges through a resistor 6, there is obtained an envelope control signal, as depicted in the figure, which has an amplitude corresponding to the key depression speed. This envelope signal is applied to a gating circuit 7 to control the amplitude of a tone source signal, corresponding to the depressed key, from a tone source circuit 8.

As seen from the above, the known system demands the use of two capacitors for each key of the instrument. Since the current integrated circuit (IC) fabrication technology does not allow integration of capacitors of this class into a microminiature circuit, the IC for touch-responsive control of an electronic musical instrument has required the provision of a multiplicity of leads for connection to the external capacitors. Further, the capacitors requires a large space on a circuit board. Therefore, it is desirable to reduce the number of capacitors to an absolute minimum.

It is also known from the Japanese Utility Model Publication No. Sho 48-42932 to provide a one-capacitor type touch-responsive control for an electronic musical instrument, in which the capacitor is charged during key-off time and is charged and discharged through a key switch circuit.

SUMMARY OF THE INVENTION

It is, therefore, an object of the present invention to provide a touch-responsive control system for an electronic musical instrument suitable for manufacture in the form of an IC.

Another object of the invention is to provide a one-capacitor type touch-responsive control device in which the capacitor is charged during key-on operation so that the tone production after the key-off can be selectively performed.

Still another object of the invention is to prevent the production of click noise due to the steep rises or falls of the tone signals under the control of the touch-responsive volume control.

According to the invention, a touch-responsive control system is provided which requires but a single capacitor for each key. The single capacitor is charged to a predetermined degree during a short period of time immediately following the commencement of key depression, when the movable contact of a key switch moves out of engagement with its break contact. The electric charge on the capacitor is subsequently released through a first discharge circuit until full depression of the key, when the movable contact of the key switch comes into engagement with its make contact, and thereafter through a second discharge circuit. The output from this second discharge circuit is utilized to control a tone source signal corresponding to the depressed key. Thus, the tone source signal is controlled in accordance with the speed of key depression.

The above described and other features of the invention will become apparent from the description made hereinbelow with reference to the accompanying drawings.

DETAILED DESCRIPTION OF PREFERRED EMBODIMENTS

Figure 1:
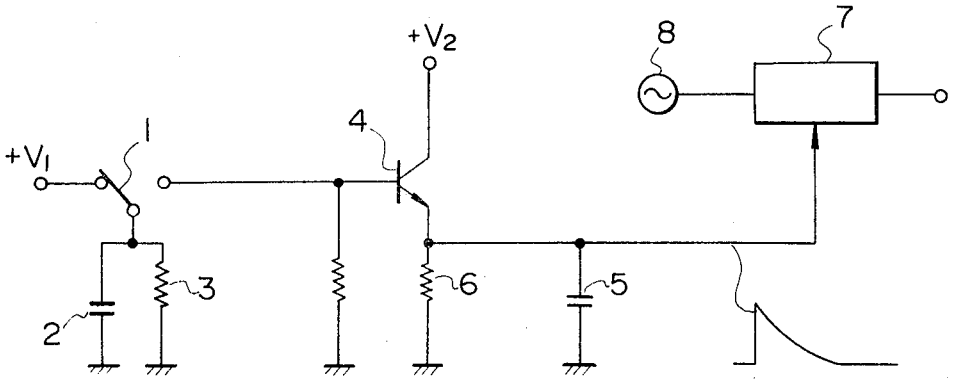
FIG. 1 (PRIOR ART)
FIG. 1 is a schematic diagram of the prior art touch-responsive volume control system for an electronic musical instrument.
Figure 2:
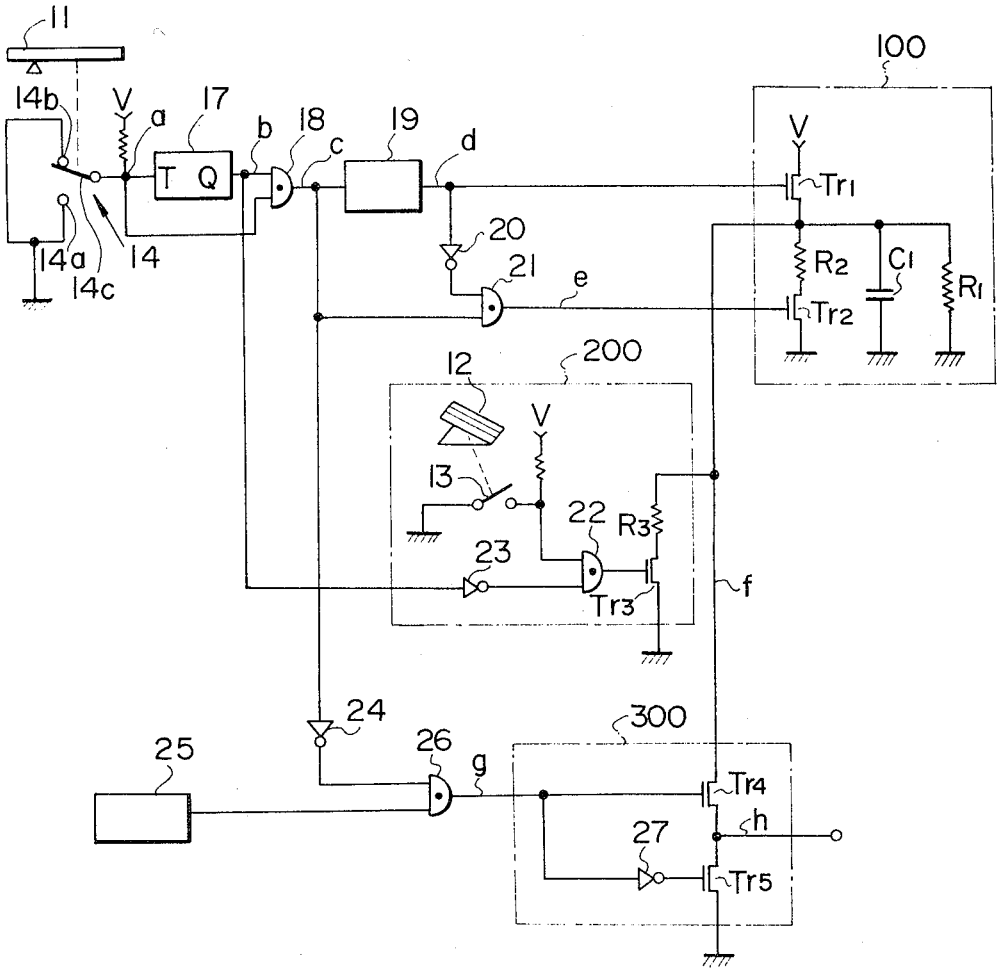
FIG. 2 is a schematic diagram of the improved touch-responsive control system according to the present invention.

Referring to FIG. 2, the reference numeral 11 denotes one of the keys of the electronic musical instrument incorporating the touch-responsive control system of this invention. Upon depression of this key, a movable contact 14*c* of a key switch 14 moves out of engagement with a break contact 14*b* and into engagement with a make contact 14*a*, the contacts 14*a* and 14*b* being commonly grounded. Upon release of the key 11, the movable contact 14*c* of the key switch 14 returns from the make contact 14*a* to the break contact 14*b*.

Figure 3:
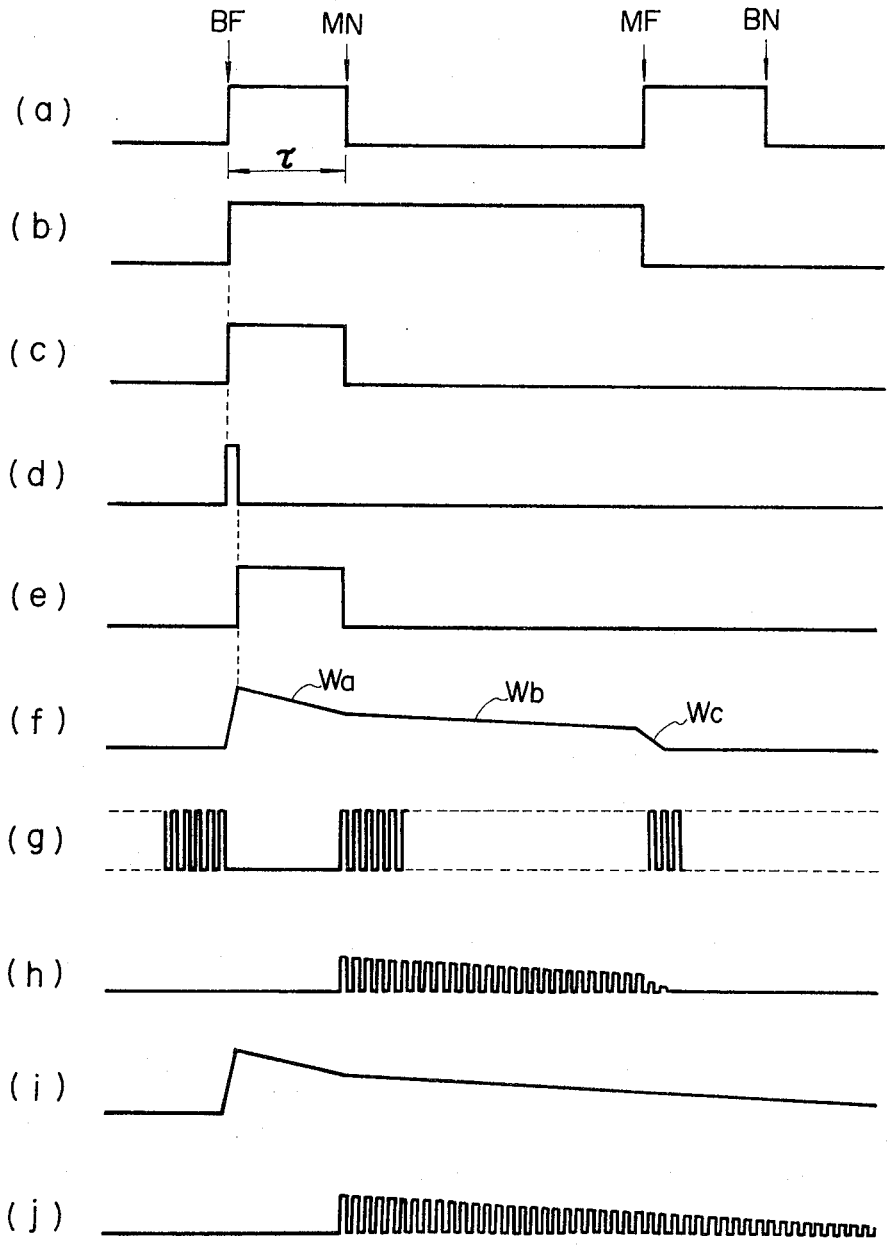
FIG. 3, (a) through (j), is a chart of waveforms useful in explaining the operation of the system of FIG. 2.

A signal produced on a line a by such actuation of the key 11 has a waveform shown at (a) in FIG. 3. When the movable contact 14*c of the key switch 14 moves out of engagement with the break contact 14b* by depression of the key at moment BF, the signal on the line a rises to a voltage V (a logical "1"). Upon subsequent engagement of the movable contact 14*c* with the make contact 14*a* at moment MN, the signal on the line a falls back to a ground level ("0"). When the movable contact 14c moves out of engagement with the make contact 14a at moment MF upon release of the key 11 which is returned to its initial position by a spring (not shown), the signal on the line a rises to "1" again. When the movable contact 14c re-engages the break contact 14b at moment BN, the signal falls to "0". The time from the disengagement of the movable contact 14c from the break contact 14b to its engagement with the make contact 14a corresponds to the speed at which the key 11 has been depressed; that is, the time $\tau$ is in inverse proportion to the speed of key depression.

The signal on the line a enters a type-T flip-flop 17 which is set when the input signal rises to "1" and reset when the input signal rises to "1" the next time. The output from the Type-T flip-flop 17 (i.e., a signal on a line b) is shown at (b) in FIG. 3. The output from the type-T flip-flop 17 is applied to a first input of an AND gate 18. A second input of the AND gate 18 directly receives the signal from the line a. Accordingly, the output from the AND gate 18 (i.e., a signal on a line c) assumes a waveform shown at (c) in FIG. 3.

This signal on the line c is applied to a monostable circuit 19. The monostable circuit 19 differentiates the rise portion of each input pulse and puts out a pulse with a duration of three to four milliseconds (msec). The voltage waveform on a line d is threfore as given at (d) in FIG. 3.

The output from the monostable circuit 19 is applied to the gate of a first field-effect transistor (FET) $Tr_1$ in a touch response circuit 100. The output from the monostable circuit 19 also is applied to a first input of an AND gate 21 through an inverter 20. The AND gate 21 receives through its second input the output from the AND gate 18. The output from the AND gate 21 (i.e., a signal on a line e) bears the waveform represented at (e) in FIG. 3. The signal on the line e is applied to the gate of a second FET $Tr_2$ in the touch response circuit 100. This touch response circuit functions to create, in response to the signals on the lines d and e, an envelope control signal having a waveform varying in accordance with the speed of key depression.

Upon receipt of the output pulse (at (d) in FIG. 3) from monostable circuit 19, the first FET $Tr_1$ becomes conductive thereby causing a capacitor $C_1$ to be charged instantaneously from a voltage supply V. The second FET $Tr_2$ is now off for the output from the AND gate 21 is still "0", as at (e) in FIG. 3. The capacitor $C_1$ is charged as above with a time constant that is determined by the product of its capacitance and the internal resistance of the first FET $Tr_1$. Upon falling of the output from the monostable circuit 19 to "0" and rising of the output from the AND gate 21 to "1", the first FET $Tr_1$ becomes nonconductive, and the second FET $Tr_2$ conductive, thereby initiating the discharge of the capacitor $C_1$.

In the following description, it is first assumed that a damper pedal 12 is not depressed, holding open a damper switch 13 in a damper circuit 200. When the damper switch 13 is open, a "1" signal is applied to a first input of an AND gate 22 from a voltage supply V thereby enabling this AND gate. A second input of the AND gate 22 receives the output from the type-T flip-flop 17 via an inverter 23. Since the output from the type-T flip-flop 17 at this time is "1", the output from the AND gate 22 is still "0".

Accordingly, the capacitor $C_1$ first discharges through two paths, one including a resistor $R_1$ and the other including a resistor $R_2$ and the second FET $Tr_2$. The time constant for such discharge of the capacitor $C_1$ is the product of its capacitance and the resistance of a parallel circuit of the resistors $R_1$ and $R_2$ and the internal resistance of the second FET $Tr_2$. The portion Wa of the waveform shown at (f) in FIG. 3 represents the gradual voltage drop thus caused on a line f by the above discharge of the capacitor $C_1$.

When the movable contact 14c of the key switch 14 engages with the make contact 14a upon full depression of the key 11, the output from the AND gate 21 falls to "0". so that the second FET $Tr_2$ becomes nonconductive. The charge now remaining on the capacitor $C_1$ is determined depending on how fast the key 11 has been depressed. Upon turning off of the second FET $Tr_2$, the remaining charge of the capacitor $C_1$ is liberated through the resistor $R_1$ only. The voltage variation on the line f at this time is as depicted at Wb at (f) in FIG. 3.

Upon falling of the output from the type-T flip-flop 17 to "0" by release of the key 11, the output from the AND gate 22 becomes "1" to initiate conductive through a third FET $Tr_3$. Accordingly, the capacitor $C_1$ rapidly discharges through both resistors $R_1$ and $R_3$, as indicated at Wc at (f) in FIG. 3. The signal on the line f is applied to a gate circuit 300. The respective resistance values of the resistor $R_1$, $R_2$ and $R_3$ are preferably determined according to the tone range to which the key 11 belongs. Generally the resistance values are selected to be $R_3 < R_2 << R_1$ where the characters represents the respective resistance values of the corresponding resistors.

The gate circuit 300 controls the amplitude or envelope of a tone source signal, generated in the form of a rectangular wave by a tone source circuit 25, in accordance with the signal on the line f, in order to provide a tone signal whose envelope corresponds to the speed of key depression. The tone source signal of a frequency corresponding to the pitch of the key 11 is applied by the tone surce circuit 25 to a first input of an AND gate 26. The AND gate 26 receives through its second input a signal produced by inverting the output from the AND gate 18 (i.e., the signal on the line c) by an inverter 24.

Thus, as is manifest from (g) in FIG. 3, the AND gate 26 constantly produces the tone source signal on its output line g except for each brief time interval when the movable contact 14c of the key switch 14 is traveling from break contact 14b to make contact 14a. The AND gate 26 applies its output to the gate of a fourth FET $Tr_4$ and also, via an inverter 27, fifth FET $Tr_5$, both included in the gate circuit 300. The FET's $Tr_4$ and $Tr_5$ are therefore alternately switched on and off, providing the desired tone signal, shown at (h) in FIG. 3, on an output line h connected to the junction between the drain of the fourth FET $Tr_4$ and the source of the fifth FET $Tr_5$.

When the damper pedal 12 is depressed to close the damper switch 13, one of the two inputs to the AND gate 22 becomes "0" and so disables same. Accordingly, the third FET $Tr_3$ does not conduct when the output from the inverter 23 rises to "1" upon release of the key 11. Since then the capacitor $C_1$ discharges only through the resistor $R_1$ even after the key 11 is returned, the voltage of the line f varies as at (i) in FIG. 3. Given at (j) in FIG. 3 is the tone signal obtained by controlling the amplitude of the tone source signal with the waveform of FIG. 3 (i).

Figure 4:
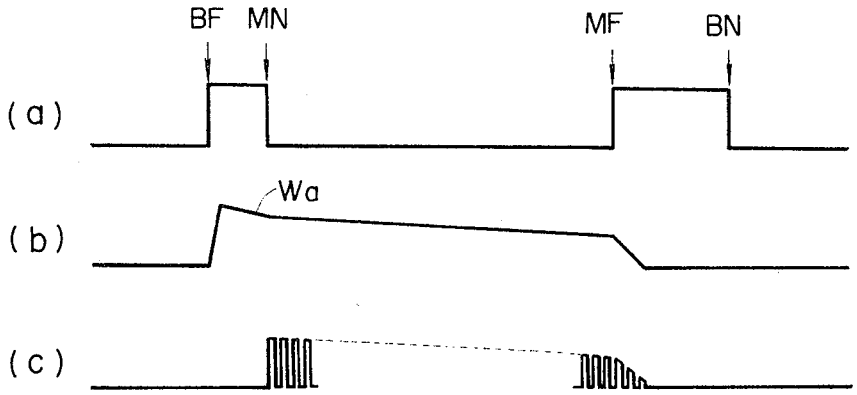
FIGS. 4 (a) through (c), and FIGS. 5, (a) through (c), are both charts of waveforms explanatory of the operation of the system of FIG. 2 when the key is depressed at high and low speeds, respectively.
Figure 5:
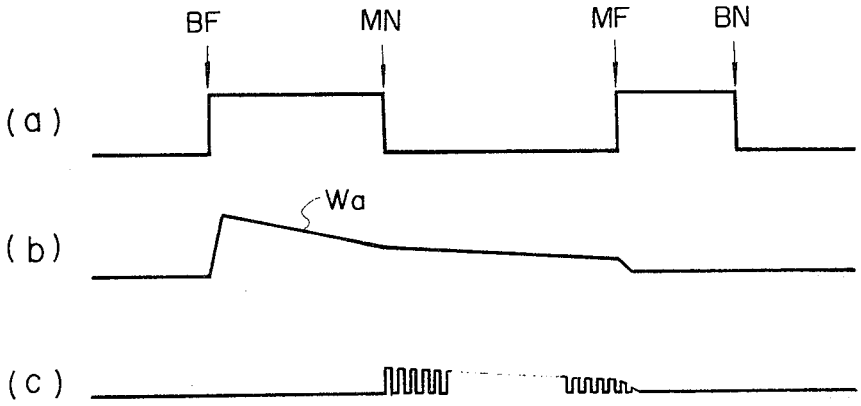

FIGS. 4 and 5 are explanatory of the way in which the wavwform of the envelope control signal, and therefore the volume of the tone, varies depending upon the speed of key depression.

At (a) in FIG. 4 is given an example of the signal on the line a when the key 11 is depressed fast. FIG. 4 (b) shows the signal thereby produced, on the line f, and FIG. 4 (c) represents the corresponding tone signal. FIG. 5, (a) through (c), illustrates corresponding waveforms generated when the key is depressed slowly.

When the key is struck strongly and so depressed at high speed, the movable contact 14*c* of the key switch 14 quickly travels from its break contact 14*b* to make contact 14*a*. Since then the capacitor $C_1$ is allowed to discharge during a correspondingly brief length of time through the resistor $R_1$ and through the resistor $R_2$ and the second FET $Tr_2$, the capacitor offers a comparatively small voltage drop from the moment BF when the movable contact 14*c* disengages the break contact 14*b* to the moment MN when the movable contact 14*c* engages the make contact 14*a*, as indicated at Wa in FIG. 4 (b). The potential of the capacitor at the latter moment MN is therefore relatively high, so that the amplitude of the output tone signal becomes large as at (c) in FIG. 4, resulting in high-volume tone production.

When the key is struck lightly and so depressed at low speed, the movable contact 14*c* of the key switch 14 requires a longer period of time in traveling from its break contact 14*b* to make contact 14*a*. In this case, as noted at Wa in FIG. 5 (b), the capacitor $C_1$ provides a correspondingly great voltage drop fromthe moment BF when the movable contact 14*c* disengages from the break contact 14*b* to the moment MN when the movable contact 14*c* engages the make contact 14*a*. Accordingly, the potential of the capacitor at the latter moment MN is low, so that the amplitude of the output tone signal becomes small, as at (c) in FIG. 5, for low-volume tone production.

Figure 6:
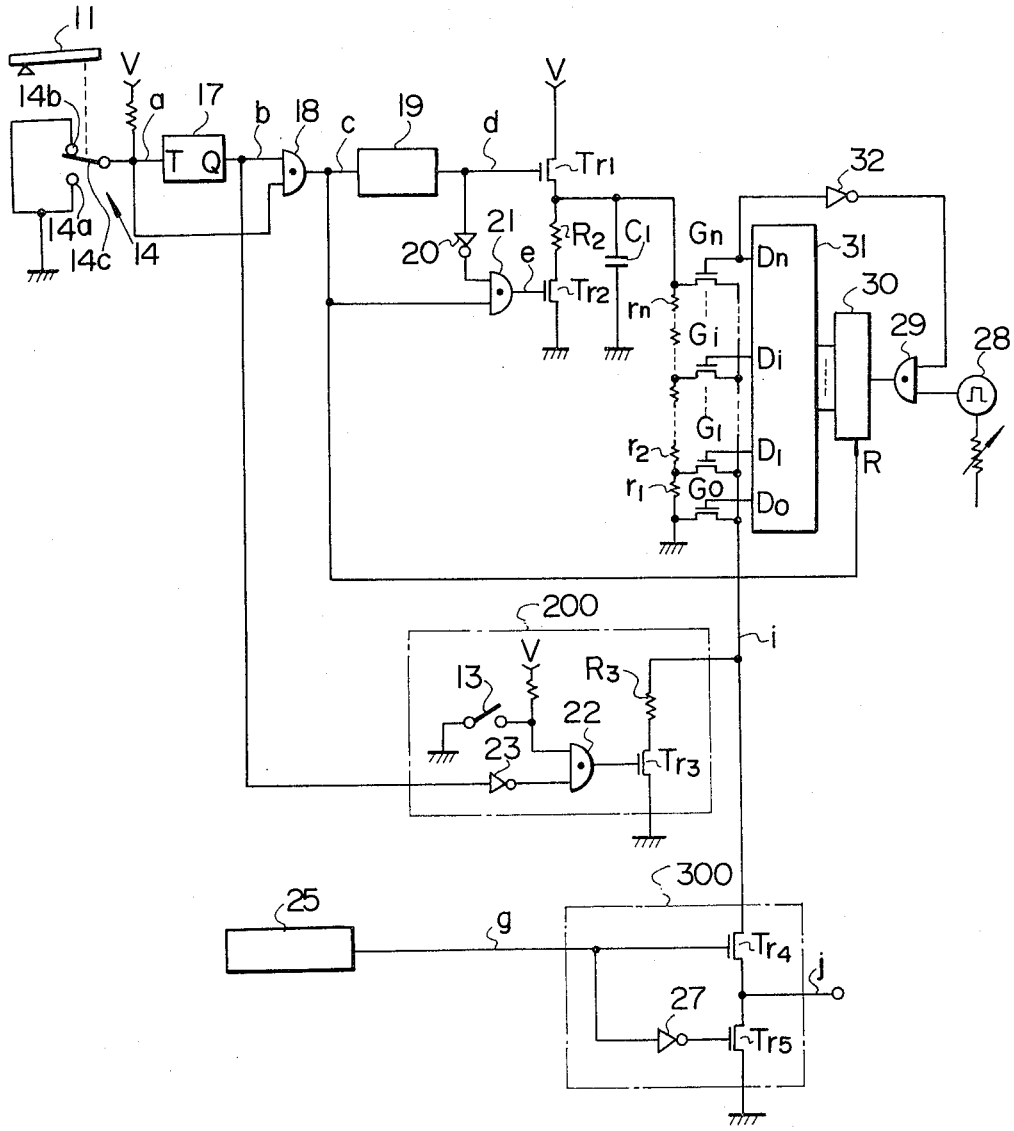
FIG. 6 is a schematic diagram of another preferred form of the touch-responsive volume control system according to the invention.

FIG. 6 shows another preferable form of the touch-respective volume control system according to the invention.

The rise portions of the tone signal produced by the system of FIG. 2 are so steep that they may give rise to click noise. Besides, the rise time of the tone signal according to the FIG. 2 system is constant and not adjustable.

Figure 7:
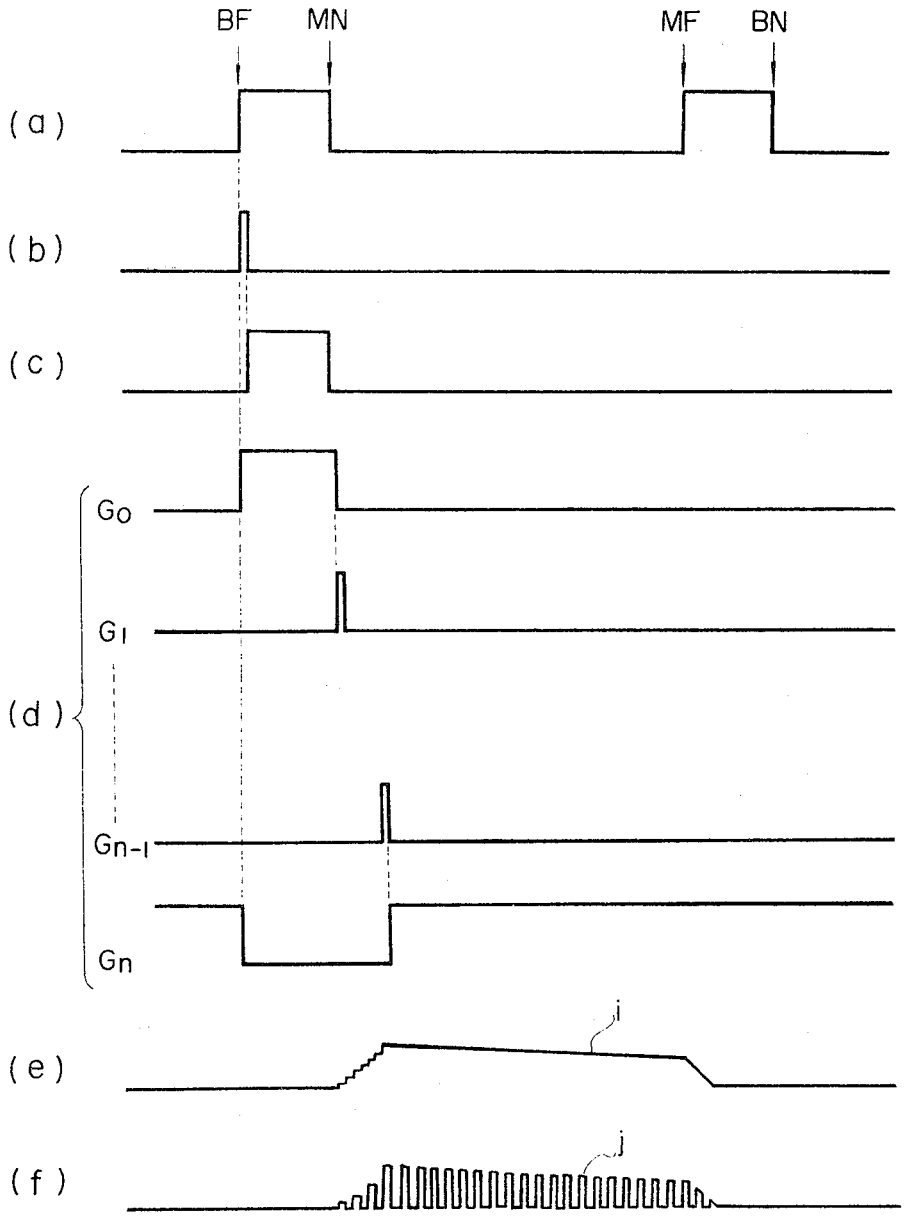
FIGS. 7, (a) through (f), is a chart of waveforms useful in explaining the operation of the system of FIG. 6.

In the embodiment shown in FIG. 6, the resistor $R_1$ of FIG. 2 is divided into n parts to form a voltage divider. When the movable contact 14*c* of the key switch comes into engagement with the make contact 14*a*, the terminal voltage of capacitor $C_1$ is taken out in sequence through the respective voltage dividing points, thereby providing a tone signal that rises gently. Most parts or components in the system of FIG. 6 have their corresponding parts in the FIG. 2 system. Like reference characters are employed to denote such corresponding parts, and their description will not be repeated. In FIG. 7, waveform (a) depicts the key switch signal at the node a of the FIG. 6 embodiment.

As the monostable circuit 19 puts out a pulse of short duration, shown at (b) in FIG. 7, upon depression of the key 11, the first FET $Tr_1$ becomes conductive to cause the capacitor $C_1$ to be instantaneously charged from the voltage supply V. Upon subsequent fall of the output of the monostable circuit 19 and rise of the output of the AND gate 21 as at (c) in FIG. 7, the first FET $Tr_1$ turns off and the second FET $Tr_2$ turns on. Now the capacitor $C_1$ starts discharging. This discharge of the capacitor $C_1$ takes place both through the series combination of the resistor $R_2$ and the second FET $Tr_2$ and through the series combination of resistors $r_1$ through $r_n$ forming a voltage divider. A counter 30 at this time is in a reset state because the output from the AND gate 18 is "1", so that a "1" is output produced from the output terminal $D_0$ of a decoder 31, which decodes the outputs from the counter 30. Accordingly, an FET gate $G_0$ (hereinafter referred to simply as "gate") is enabled, and a line i is now at ground potential.

When the movable contact 14*c* of the key switch 14 comes into engagement with the make contact 14*a* upon full depression of the key 11, the output from the AND gate 21 falls to terminate conduction through the second FET $Tr_2$. With the discharge path through the resistor $R_2$ and the second FET $Tr_2$ thus blocked, the capacitor $C_1$ thereafter discharges through the path of the resistors $r_1$ through $r_n$.

The counter 30 is set into operation upon falling of the output from the AND gate 18 and thereafter is driven by a train of clock pulses applied from a variable oscillator 29 through an AND gate 29. Another input of the AND gate 29 receives via an inverter 32 the output from the output terminal $D_n$ of the decoder 31 and thus is now enabled. The counter 30 delivers its outputs to the decoder 31. In response to the counter outputs, the decoder 31 produces outputs from successive terminals $D_0$ through $D_n$, for application to the respective gates $G_0$ through $G_n$ to cause conduction through the FET's.

When the counter 30 counts up to n, a "1" output is produced from the terminal $D_n$ of the decoder 31. This "1" output is inverted by the inverter 32 and applied to the AND gate 32 to disable it. The counter 31 therefore stops the counting operation and the decoder 31 is held in a state where the "1" output is produced from its terminal $D_n$. Accordingly, the gate $G_n$ is held enabled thereafter. The on-off states of the gates $G_0$–$G_n$ operating in the above described manner are graphically summarized at (d) in FIG. 7.

The waveform at (e) in FIG. 7 represents the envelope control signal thus obtained on the line i. It will be seen that the signal rises stepwise, like a staircase, from ground potential to the full voltage of the capacitor $C_1$. This envelope control signal is applied to the gate circuit 300 for controlling the amplitude of tone source signal from the tone signal circuit 25 in the previously described manner. The waveform of the tone signal produced on the line j by such amplitude control is plotted at (f) in FIG. 7. The rise or attack portion of the tone signal can be determined as described by adjusting the frequency of oscillations of the variable oscillator circuit 28.

The waveforms shown at (e) and (f) in FIG. 7 are obtained when the damper switch 13 in the damper circuit 100 is off. When the damper switch 13 is on, the tone signal will not decay rapidly after release of the key, like the one seen at (j) in FIG. 3.

Figure 8:
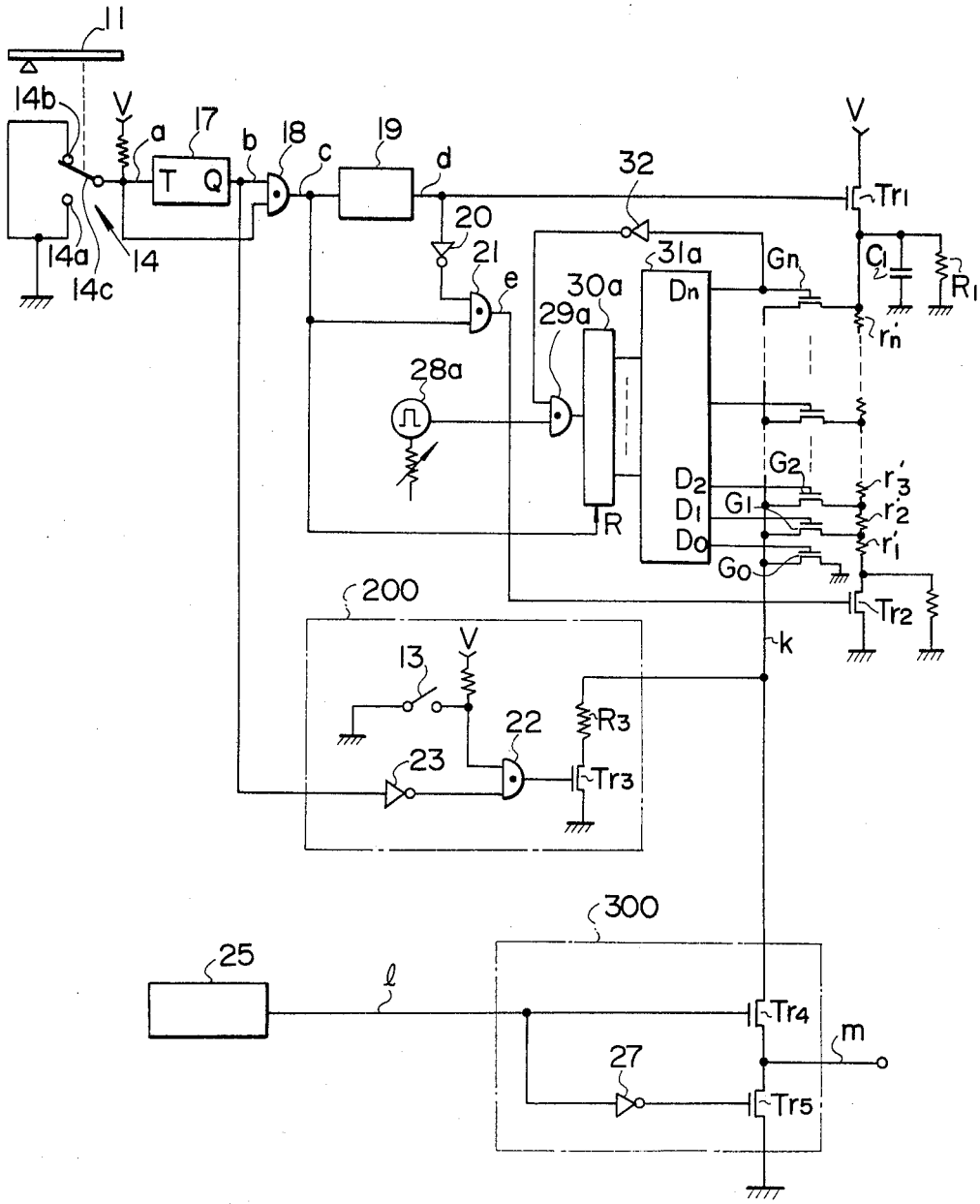
FIG. 8 is a schematic diagram of still another preferred form of the touch-responsive volume control system according to the invention.

FIG. 8 shows still another embodiment which also seeks to provide a gently rising tone signal. In this embodiment, however, the resistor $R_2$ of FIG. 2 is divided into n risistors $r'_1$ athrough $r'_n$, just as the resistor $R_1$ is divided into several resistors in the system of FIG. 6. A counter 30*a* in this embodiment is also reset by the output from the AND gate 18. Upon appearance of a pulse from the AND gate 18 by depression of the key, the counter 30*a* is reset, and upon disappearance of this pulse the counter 30*a* is set into operation. The counter 30*a* is driven by the clock pulses fed from a variable oscillator 28*a* via an AND gate 29*a*. In step with the progress of counting operation by this counter, a decoder 31*a* produces "1" outputs from one after the other of its output terminals $D_0$ through $D_n$. The FET gates $G_0$ through $G_n$ become successively conductive in response to the outputs from the decoder 31*a*. There is thus obtained on a line k the desired envelope control signal bearing the waveform plotted at (b) in FIG. 9. The envelope control signal enters the gate circuit 300, which correspondingly controls the amplitude of the tone source signal, having a frequency corresponding to the pitch of the depressed key, from the tone source circuit 25. At (c) in FIG. 9 is shown the waveform of the tone signal thus produced on a line m in accordance with the speed of key depression.

Figure 9:
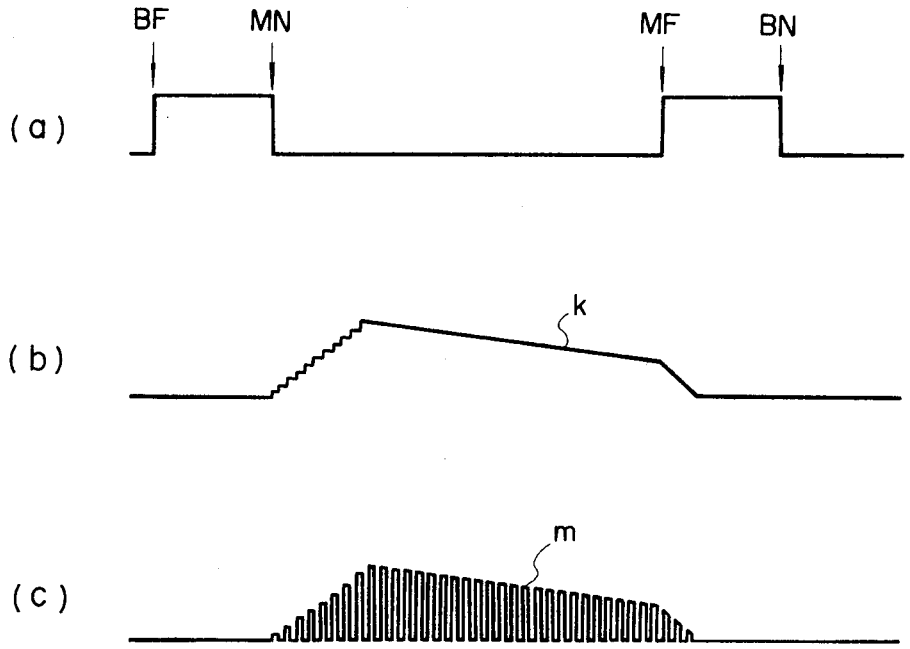
FIG. 9, (a) thorugh (c), is a chart of waveforms useful in explaning the operation of the system of FIG. 8.

The waveform shown at (a) in FIG. 9 represents the signal on the line a. The waveforms of (b) and (c) in FIG. 9 are depicted, as are those of (e) and (f) in FIG. 7, on the assumption that the damper switch 13 in the damper circuit 200 is off.

In the systems of FIGS. 6 and 8, the signal on the line i or line k appears at the moment when the movable contact 14*c* of the key switch 14 comes into engagement with the make contact 14*a*. The AND gate 26 shown in FIG. 2 is therefore unnecessary in these systems.

In the embodiments shown in FIGS. 6 and 8, click noise at the rises of the tone signal is eliminated by causing conduction through the successive gates $G_0$ through $G_n$, in that order, by the outputs from the decoder 31. It will be obvious from this that the occurrence of clicks due to the abrupt decays of the tone signal can be prevented by successively causing conduction through the gates in the reversed order of $G_n$ through $G_0$. Such an abrupt decay of a tone signal would take place, for example, when the tone being produced through some tone production channel of a polyphonic electronic musical instrument must be truncated due to some necessity in channeling operation. The click noise which is liable to be produced in such a case will be prevented by gradually reducing the voltage on the line i or k down to the ground level by taking advantage of the outputs from the decoder.

Further, though in the above embodiments the touch-responsive control signal is used to amplitude-control the tone source signal, it should be noted that such other tonal quality as tone color and tone pitch may also be controlled by the touch response signal.

The foregoing disclosure will have made clear that the improved touch-responsive volume control system according to the invention requires only one capacitor for each key, compared with two capacitors heretofore required for each key. This fact, combined with the relatively simple configuration of the circuitry, makes the system well adapted for economical fabrication in the form of an IC.

What is claimed is:

1. In an electronic musical instrument having a keyboard including a plurality of keys, an apparatus responsive to the depression of a key for controlling a tone signal corresponding to said key in accordance with the speed of key depression, comprising:

(a) a key switch associated with said key and having a movable contact, a make contact and a break contact, the movable contact being normally held in engagement with the break contact and moved into enagagement with the make contact upon depression of the key;

(b) a capacitor;

(c) a charging circuit for charging the capacitor during a preassigned length of time following the movement of the movable contact of the key switch out of engagement with the break contact and before engagement with the make contact upon depression of the key;

(d) first discharge means for causing the capacitor to discharge at a first predetermined rate during the interval from the charging of the capacitor to the engagement of the movable contact of the key switch with the make contact;

(e) second discharge means for causing the capacitor to discharge at a second predetermined rate after the engagement of the movable contact of the key switch with the make contact; and (f) means responsive to a terminal voltage of the capacitor when the movable contact of the key switch comes into engagement with the make contact, which terminal voltage is a function of the key depression speed, for controlling the tone signal corresponding to the depressed key in accordance with said key depression speed.

2. The apparatus according to claim 1, wherein said responsive means includes means for controlling the amplitude of said tone signal to become large when the key depression speed becomes high.

3. The apparatus of claim 1 or 2, wherein the second discharge means include voltage divider means having a plurality of voltage dividing points to voltage-divide the terminal voltage of said capacitor and means for sequentially coupling the respective voltage dividing points with said responsive means following the engagement of the movable contact of the key switch with the make contact.

4. The apparatus of claims 1 or 2, further comprising third discharge means for causing the capacitor to discharge at a third predetermined rate after the movable contact of the key switch moves out of engagement with the make contact upon release of the key.

5. The apparatus of claim 4, wherein said third discharging is larger than said second discharging rate.

6. The apparatus of claim 5, wherein said first discharging rate is between said third and second discharging rates in magnitude.

7. The system of claim 5, wherein the third discharge means includes damper means for permitting the capacitor to discharge at said second predetermined rate even after the movable contact of the key switch moves out of engagement with the make contact upon release of the key.

8. In an electronic musical instrument having a keyboard including a plurality of keys, an apparatus responsive to the depression of a key for controlling a tone signal corresponding to said key in accordance with the speed of key depression, comprising:

(a) switch means for producing a voltage pulse having a duration which is a function of the speed of depression of the key;

(b) a capacitor;

(c) a charging circuit for charging the capacitor during a predetermined period in response to the initiation of the voltage pulse;

(d) a first discharge means for causing the capaictor to discharge at a first predetermined rate during an interval initiated by the charging of the capacitor and terminated in response to the termination of the voltage pulse;

(e) a second discharge means for causing the capacitor to discharge at a second predetermined rate after the terminaton of the voltage pulse; and (f) a means responsive to a terminal voltage of the capacitor after the termination of the switch means voltage pulse, which terminal voltage is a function of the key depression speed, for controlling the tone signal corresponding to the depressed key in accordance with said key depression speed.

9. The apparatus according to claim 8, wherein said responsive means includes means for controlling the amplitude of said tone signal to become large when the key depression speed becomes high.

10. The apparatus of claim 8 or 9, wherein the second discharge means includes voltage divider means having a plurality of voltage dividing points to voltage-divide the terminal voltage of said capacitor, and means for sequentially coupling the respective voltage dividing points with said responsive means following the termination of the switch means voltage pulse.

11. The apparatus of claims 8 or 9, further comprising third discharge means for causing the capacitor to discharge at a third predetermined rate after the depression of the key is terminated.

12. The apparatus of claim 11, wherein said third discharging rate is faster than said second discharging rate.

13. The apparatus of claim 12, wherein said first discharging rate is between said third and second discharging rates in magnitude.

14. The apparatus of claim 12, wherein the third discharge means includes damper means for permitting the capacitor to discharge at said second predetermined rate even after the depression of the key is terminated.

15. In an electronic musical instrument having a keyboard including a plurality of keys, an apparatus responsive to the depression of a key by manual actuation, for controlling a tone signal corresponding to said key in accordance with the speed of key depression, comprising:

(a) switch means, responsive to the manual actuation of a key, for producing a voltage pulse having a duration which is a function of the speed of depression of the key;

(b) a capacitor;

(c) a charging circuit for charging the capacitor to a predetermined level, in response to the depression of the key;

(d) first discharge means for discharging the capacitor at a first predetermined rate during a first interval having a duration which is a function of the switch means voltage pulse duration wherein the terminal voltage of the capacitor at the end of the interval is a function of the speed of depression of the key;

(e) second discharge means for discharging the capacitor at a second predetermined rate after the first predetermined rate interval; and (f) means responsive to the terminal voltage of the capacitor, for controlling the tone signal corresponding to the depressed key in accordance with the discharging terminal voltage of the capacitor and thereby in accordance with the key depression speed.

16. The apparatus of claim 15 wherein the charging circuit includes a voltage source, a first transistor switch operably connecting the voltage source to the capacitor and means responsive to the voltage pulse, for turning the transistor switch on for a second predetermined interval thereby charging the capacitor to the predetermined level.

17. The apparatus of claim 16, wherein the transistor turn on means includes a monostable circuit which is triggered by the rise of the voltage pulse and produces a second voltage pulse having a duration sufficient to turn on the transistor switch for the second predetermined interval.

18. The apparatus of claim 16 wherein the first discharge means comprises a discharge path, a second transistor switch operably connecting the discharge path to the capacitor and a second means, responsive to the voltage pulse, for turning on the second transistor switch for said first interval wherein the capacitor is discharged through the discharge path during the first interval.

19. In an electronic musical instrument having a keyboard including a plurality of keys, an apparatus responsive to the depression of a key for controlling a tone signal corresponding to said key in accordance with the speed of key depression, comprising:

(a) switch means for producing a voltage pulse having a duration which is a function of the speed of depression of the key;

(b) a capacitor and a charging circuit for charging the capacitor to a voltage level which is a function of the switch means voltage pulse duration and hence the key depression speed;

(c) discharge means for discharging the capacitor after said voltage level is achieved; and (d) means responsive to the discharging capacitor voltage for controlling the tone signal in accordance with the capacitor voltage and thereby in accordance with the key depression speed.

20. A touch responsive control apparatus for a keyboard electronic musical instrument, comprising:

a switch mechanically movable from a first position to a second position upon depression of a key in said keyboard, a capacitor, charging means for rapidly charging said capacitor to a first level upon initial movement of said switch away from said first position upon depression of a key, and discharging means for then discharging said capacitor at a fixed rate until said switch reaches said second position during said key depression, the resultant voltage on said capacitor being indicative of the speed of depression of said key.

* * * * *